US005204591A

United States Patent [19]

Kaitandjian et al.

[11] Patent Number: 5,204,591

[45] Date of Patent: Apr. 20, 1993

[54] DEVICE FOR CONTROLLING AT LEAST ONE ELECTRONIC SERVOMOTOR WITH HIGH POWER FROM A LOW-VOLTAGE NETWORK, IN PARTICULAR FOR MOTORIZING A TURRET ON A TANK

[75] Inventors: Michel Kaitandjian, Le Chesnay; Philippe J. Pradat, Les Ulis; Emile Y. Urvoy, Limours, all of France

[73] Assignee: Compagnie de Signaux et D'Equipements, France

[21] Appl. No.: 652,398

[22] Filed: Feb. 7, 1991

Related U.S. Application Data

[63] Continuation of Ser. No. 348,273, May 5, 1989, abandoned.

[30] Foreign Application Priority Data

May 6, 1988 [FR] France ..... 88 06161

[51] Int. Cl.[5] ..... H02P 1/54

[52] U.S. Cl. ..... 318/106; 318/98; 318/112

[58] Field of Search ..... 388/825-835, 388/920, 910; 318/34, 49-50, 35, 38, 66-67, 98-99, 105-110, 112

[56] References Cited

U.S. PATENT DOCUMENTS 4,482,848 11/1984 Heal et al. ..... 318/98

*Primary Examiner*—William M. Shoop, Jr.
*Assistant Examiner*—David Martin
*Attorney, Agent, or Firm*—Anthony J. Casella; Gerald E. Hespos

[57] ABSTRACT

Device for controlling at least one electric servomotor with high power from a low-voltage network, in particular for motorizing a turret on a tank, characterized in that it comprises, in combination:

a voltage booster converter (C), a reversible chopping amplifier ($A_1$, $A_2$) fed by the converter (C) and delivering the current required by the motor to be controlled ($M_1$, $M_2$) which is of the type able to operate as a generator, and a capacitive type electric energy accumulator (B) inserted between the converter (C) and the amplifier ($A_1$, $A_2$).

4 Claims, 2 Drawing Sheets

DEVICE FOR CONTROLLING AT LEAST ONE ELECTRONIC SERVOMOTOR WITH HIGH POWER FROM A LOW-VOLTAGE NETWORK, IN PARTICULAR FOR MOTORIZING A TURRET ON A TANK

This application is a continuation of application Ser. No. 348,273 filed May 5, 1989, now abandoned.

BACKGROUND AND SUMMARY OF THE INVENTION

The present invention relates to a device for controlling at least one electric servomotor with high power from a low-voltage network. This device is more especially designed to provide the electric motorization of a heavy turret on a tank.

Very often, the motorization of the turret of a tank is provided by a hydraulic servosystem. Now, in such a system, the losses and heat which result therefrom do not make it possible to use it over long periods such as required for example when firing on the move, i.e. the faculty of firing with sufficient accuracy and so efficiency when the carrier is on the move.

Low or medium voltage electric solutions are also known. The direct use of the low-voltage network present on the tank involves limiting the rated power which, in short, does not make it possible to fire on the move when travelling across country. As for the medium voltage solution, it requires a very powerful and so very bulky converter which it is generally impossible to integrate in a tank. In addition, here again, the available power is in practice not sufficient for firing on the move.

The main object of the present invention is then to overcome these drawbacks and, for this, it provides a device of the above-mentioned type which is characterized essentially in that it comprises, in combination:

- a voltage booster converter,
- bi-directional chopping amplifier fed by the converter and delivering the current required by the motor to be controlled, which is of the type able to operate as a generator, and
- a capacitive type electric energy accumulator inserted between the converter and the amplifier.

In the particular application considered here, the converter feeds simultaneously two amplifiers connected respectively to a motor controlling the lateral deflection axis of the turret and a motor controlling the elevational axis of the weapon carried by the turret.

Thus, through recovering the kinetic energy of the turret and of the weapon in the form of electric energy in the capacitive accumulator, the converter does not need to be very powerful and it is therefore less bulky. In short, there is thus available, in a volume compatible with that available in a tank, of sufficient permanent power for firing on the move under good operating conditions.

Preferably, the converter is a monoquadrant converter of push-pull type, so as to avoid any restitution of energy to the source.

In a particular embodiment of the invention, the voltage delivered by the converter is a medium voltage of about 270 V.

As for the accumulator, it is formed by a battery of parallel connected electrochemical capacitors.

Finally, the electric motor is advantageously of the type with collector and samarium-cobalt permanent magnets.

BRIEF DESCRIPTION OF THE DRAWINGS

One embodiment of the invention is described hereafter by way of example, with reference to the accompanying drawing.

DETAILED DESCRIPTION OF THE PREFERRED EMBODIMENT

Figure 1:
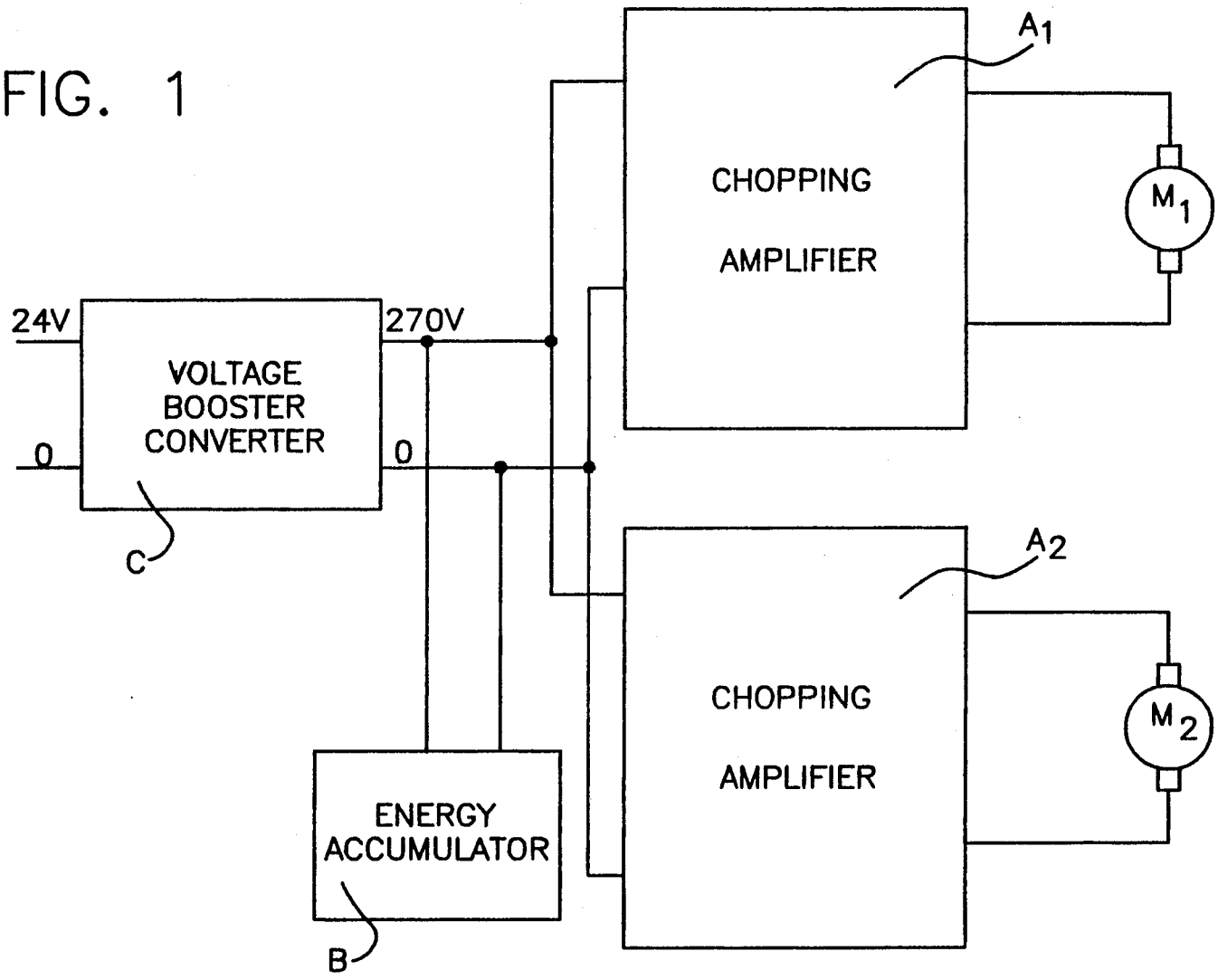
FIG. 1, is a diagram of a control device in accordance with the invention, applied to the two axis electric motorization of a tank turret.
Figure 2:
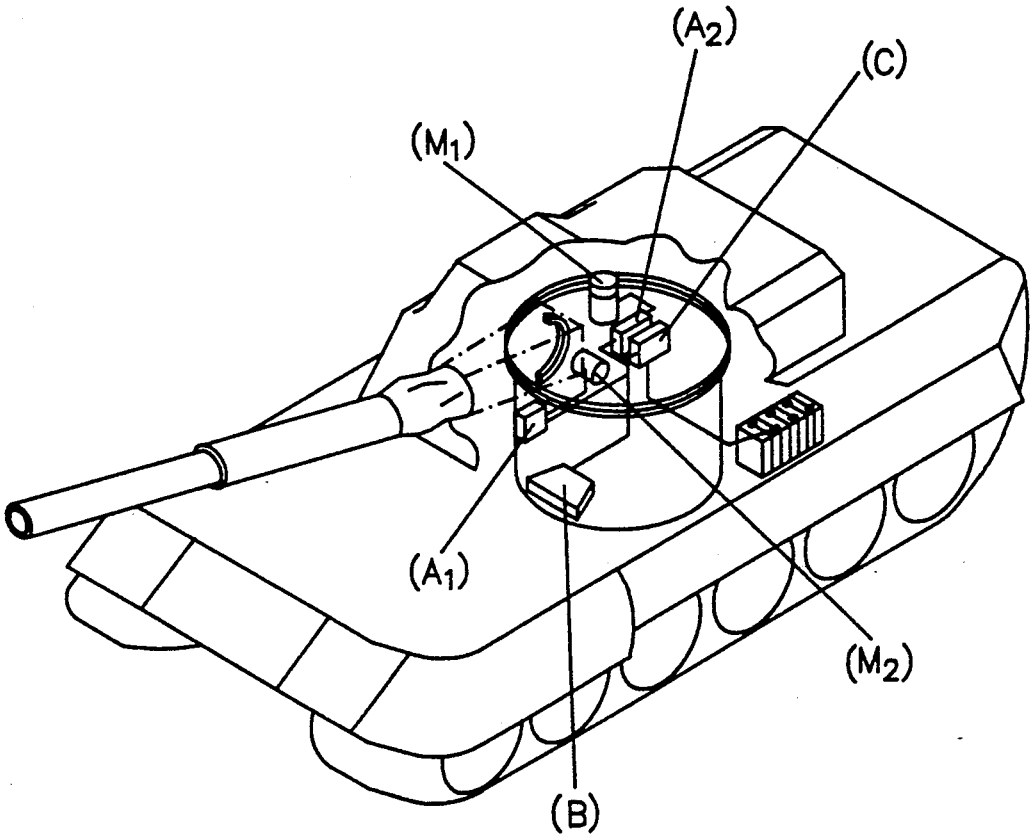
FIG. 2 schematically illustrates the control device of the subject invention as embodied in the turret of a tank.

This device is situated between a computer which gives the commands relative to each of the two axes, and the input shaft of the step-down mechanisms driving respectively the turret whose inertia is about 40,000 $m^2kg$ and the swinging of the weapon whose inertia is about 7500 $m^2kg$. It is essentially formed by a voltage booster converter C followed by two bi-directional chopper amplifiers $A_1$ and $A_2$ connected respectively to a motor $M_1$ controlling the lateral deflection axis of the turret and to a motor $M_2$ controlling the elevational axis of the weapon carried by the turret.

In accordance with the invention, an electric energy accumulator B of capacitive type is inserted between converter C and the two amplifiers $A_1$ and $A_2$.

Converter C is fed from the low-voltage on board network, for example 24 volts, and delivers at its output a medium voltage of about 270 V, which obviously involves taking a number of safety precautions for protecting the personnel. It takes from this network a power which is about ten times smaller than that which is finally used in the device, namely for example 5 kW peak, and may then be constructed in a compact form. It is monoquadrant, so irreversible, and of push-pull type with on-off regulation.

The amplifiers $A_1$ and $A_2$ are based on the principle of current choppers operating in four quadrants. Amplifier $A_1$ corresponding to the axis of the turret is dimensioned to 40 kW peak, whereas amplifier $A_2$ corresponding to the axis of the weapon is dimensioned to 12 kW peak. These electronic power amplifiers have passbands of 500 Hz and excellent linearity, as well as an excellent efficiency greater than 95%. The chopping electronic amplifier in fact forms a matching device without losses other than those required for the internal operation of its own circuits, for permanently matching the input power characterized by a constant voltage and a "free" current flow to the physical output magnitudes, i.e. the current related to the driving torque and the voltage related essentially to the speed of the shaft.

The electric motors $M_1$ and $M_2$, coupled by appropriate reducers to the elevational and lateral deflection axes, are provided so as to be able to operate as generators. In the particular example described here, they are of the type with collector and samarium-cobalt permanent magnets so as to exhibit a high torque per unit volume and a rectangular torque-speed range of use.

As for accumulator B, which forms one of the essential elements of the control device of the invention, it has a relatively high nominal capacity of the order of 1 Farad. It will for example be formed by connecting in parallel 80 electrochemical capacitors each of 12,500 $\mu F$.

This accumulator makes it possible to recover, in the form of potential electric energy, the kinetic energy available on the mechanical axes of the turret and the weapon, because of the reversibility of the control lines. This aspect is essential if we consider that the losses of the device, for example when laying the weapon, represent 10% of the energy brought into play, the remaining 90% residing in a potential energy-kinetic energy exchange, and reciprocally.

Thus, with this set of arrangements, sufficient energy is permanently available for firing on the move under good conditions. Firing on the move creates in fact new periods of use which are longer than those intended previously solely for laying and aiming the weapon. It is further necessary to have a good passband so as to obtain sufficient dynamic precision for attenuating the disturbing movements of the carrier vehicle. Finally, the size of the device must be compatible with the volume available in this carrier vehicle, in this case a tank.

We claim:

1. Device for controlling one or more electric servomotors on board a vehicle with high power from a low voltage network comprising:

a uni-directional monoquadrant voltage booster converter (C);

a first bi-directional chopping amplifier (A1) fed by the uni-directional converter (C) and delivering the current required by a first servomotor (M1) to be controlled which is of the type able to operate as a generator;

a capacitive type electric energy accumulator (B) comprised of a set of capacitors connected in parallel, inserted between the uni-directional converter (C) and the first bi-directional chopping amplifier (A1); and wherein the vehicle is a tank, which tank includes a turret that is motorized about its lateral deflection axis by said first servomotor (M1) controlled by said first chopping amplifier (A1), a weapon carried by the tank turret motorized about its elevational axis by a second servomotor (M2) controlled by a second chopping amplifier (A2), and with both said first and second amplifiers (A1; A2) being simultaneously fed by the uni-directional booster converter (C).

2. Device according to claim 1, characterized in that the converter (C) is a monoquadrant converter of push-pull type.

3. Device according to claim 2, characterized in that the voltage delivered by the converter (C) is a medium voltage of about 270 V.

4. Device according to claim 1, characterized in that the electric motors ($M_1$, $M_2$) are of the type with collector and samarium-cobalt permanent magnets.

* * * * *